US007416423B2

(12) United States Patent
Chi et al.

(10) Patent No.: US 7,416,423 B2
(45) Date of Patent: Aug. 26, 2008

(54) PORTABLE STORAGE DEVICE

(75) Inventors: Chih-Yung Chi, Taipei (TW); Kun-Chin Chiu, Taipei (TW); Chih-Hsin Wu, Taipei (TW)

(73) Assignee: Asustek Computer Inc., Peitou, Taipei (TW)

( * ) Notice: Subject to any disclaimer, the term of this patent is extended or adjusted under 35 U.S.C. 154(b) by 0 days.

(21) Appl. No.: 11/850,100

(22) Filed: Sep. 5, 2007

(65) Prior Publication Data

US 2008/0076280 A1 Mar. 27, 2008

(30) Foreign Application Priority Data

Sep. 27, 2006 (TW) ..... 95135871 A

(51) Int. Cl.
*H01R 13/44* (2006.01)

(52) U.S. Cl. ..... 439/131; 439/140; 361/731

(58) Field of Classification Search ..... 439/131, 439/122, 138, 140.141; 361/731
See application file for complete search history.

(56) References Cited

U.S. PATENT DOCUMENTS 6,062,881 A * 5/2000 Ellison ..... 439/141
6,368,129 B1 * 4/2002 Wang et al. ..... 439/260
6,676,420 B1 1/2004 Liu et al.
6,808,400 B2 * 10/2004 Tu ..... 439/131
6,887,091 B1 * 5/2005 Wu ..... 439/352
7,009,847 B1 * 3/2006 Wu et al. ..... 361/737
7,307,849 B2 * 12/2007 Ho et al. ..... 361/737
2001/0034147 A1 * 10/2001 Kerr et al. ..... 439/141
2004/0248444 A1 * 12/2004 Zhao et al. ..... 439/157
2005/0090133 A1 * 4/2005 Ma ..... 439/131
2006/0205252 A1 * 9/2006 She et al. ..... 439/131

* cited by examiner

*Primary Examiner*—Tulsidas C Patel
*Assistant Examiner*—Harshad C Patel
(74) *Attorney, Agent, or Firm*—Thomas, Kayden, Horstemeyer & Risley

(57) ABSTRACT

A portable storage device is provided. A housing has a first opening and a second opening. A storage body has a connector and a pair of positional restriction structures. The storage body slides in the housing to make the connector extend outside the housing or hide in the housing via the first opening. A pair of actuating arms is provided in the housing and can swing. An actuating structure is partially exposed outside the housing via the second opening and pivotally connected to the pair of actuating arms. An elastic element is connected to the actuating structure and the storage body, so that the elastic element pushes the storage body and drives the actuating arms to return to the original position to block the positional restriction structures.

11 Claims, 3 Drawing Sheets

PORTABLE STORAGE DEVICE

RELATED APPLICATIONS

This application claims priority to Taiwan Application Serial No. 95135871, filed Sep. 27, 2006, which is herein incorporated by reference.

BACKGROUND OF THE INVENTION

1. Field of the Invention

The invention relates to a storage device.

2. Description of the Related Art

With the rapid development of the manufacture technology of the flash memory, the flash memory with a large capacity is largely used in the storage device. Especially, the product such as the portable storage device or the thumb storage device in the market, which uses the flash memory with a large capacity, has reduced the size of the storage device like a thumb.

Nowadays, a portable storage device often uses the universal serial bus (USB) as its interface. The housing of the portable storage device usually has a lid to cover the USB connector to prevent the dust when the USB connector is not used.

However, when the portable storage device is used (for example, plugging the USB connector to the connector of the computer), the lid is put near the computer. Since the size of the lid is small, it is easy to be lost. Once the lid of the portable storage device is lost, the USB connector loses the dustproof function.

BRIEF SUMMARY OF THE INVENTION

The objective of the invention is to provide a portable storage device for making the operation by a user more convenient.

According to the objective of the invention, a portable storage device is provided. A housing has a first opening and a second opening. A storage body has a connector and a pair of positional restriction structures. The storage body is provided in the housing and moves relatively to the housing, so that the connector extends outside the housing or hides in the housing via the first opening. A pair of actuating arms is provided in the housing and can swing relatively. When the storage body hides in the housing, the pair of the actuating arms blocks the pair of positional restriction structures. An actuating structure exposes outside the housing partially via the second opening. The actuating structure is pivotally connected to the pair of actuating arms and can be forced to slide to drive the pair of actuating arms to swing relatively, so that the pair of positional restriction structures can be released. An elastic element is connected to the actuating structure and the storage body. When the pair of the positional restriction structure is released, the elastic element pushes the storage body to make the connector extend outside the housing via the first opening, and the pair of the actuating arms returns to the original position to block the positional restriction structures.

According to the embodiment of the invention, the elastic element can be a spring, and when the connector extends outside the housing, the actuating structure can be forced to drive the pair of the actuating arms to swing relatively to release the pair of the positional restriction structures, and the connector can be forced to press the spring to hide in the housing, so that the pair of the actuating arms can return to the original position to block the positional restriction structures.

BRIEF DESCRIPTION OF THE DRAWINGS

These and other features, aspects, and advantages of the present invention will become better understood with regard to the following description, appended claims, and accompanying drawings.

DETAILED DESCRIPTION OF THE EMBODIMENTS

As stated above, the invention provides a portable storage device, which a user can carry and store conveniently, and the invention provides the dustproof function of the connector of the portable storage device simultaneously.

Figure 1:
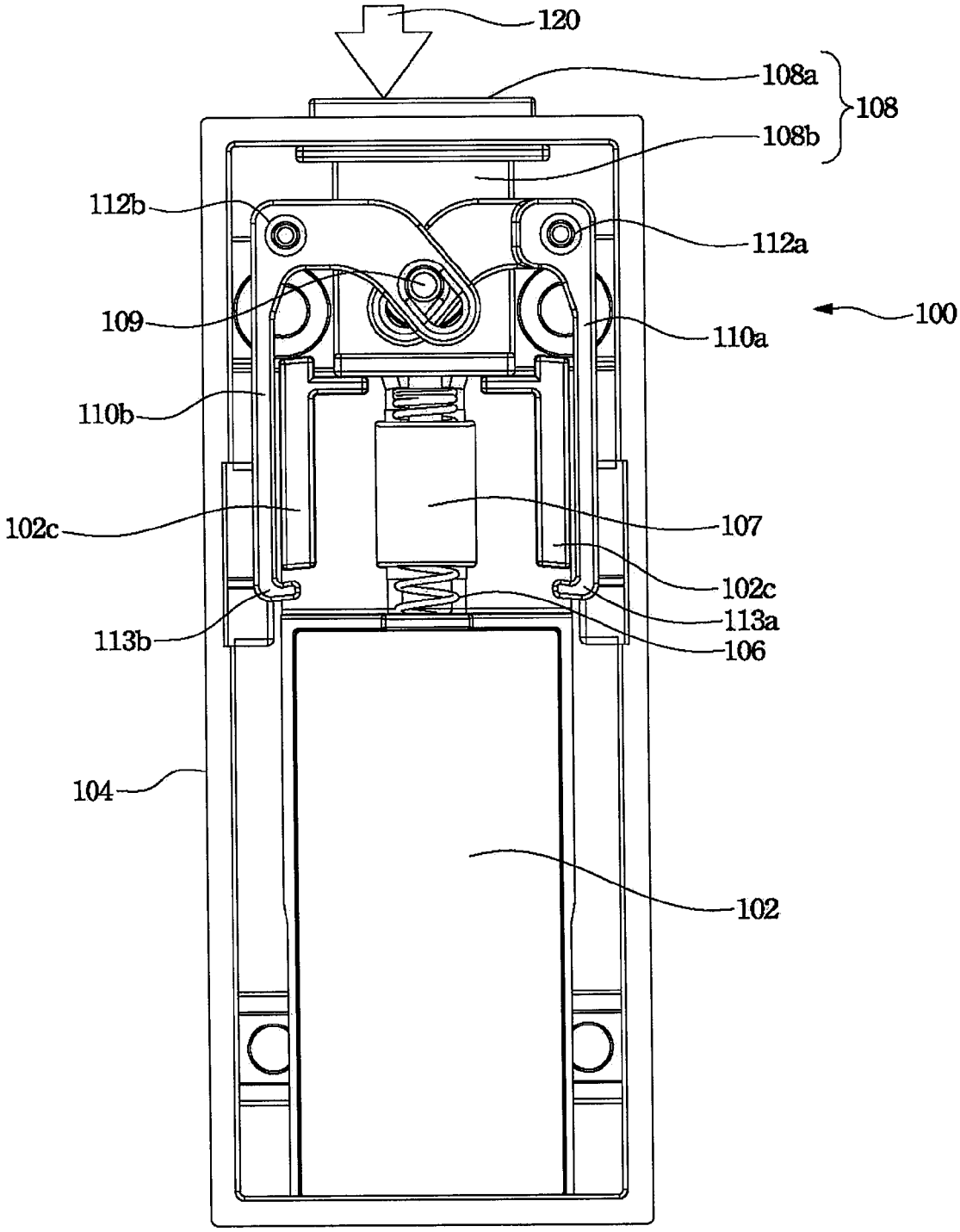
FIG. 1 shows a top view of a portable storage device (the storage body hiding in the housing) of one embodiment of the invention.

Please refer to FIG. 1, which shows a top view of a portable storage device (a storage body hiding in the housing) of one embodiment of the invention. Parts of a housing of a portable storage device 100 have been removed, so that the inner structure can be shown clearly in the FIG. 1. The portable storage device 100 includes at least the housing 104, the storage body 102 and mechanisms relative to the operation of the storage body. When the portable storage device 100 is not used (for example, the storage body 102 is not used for reading or storing data.), the storage body 102 hides in the housing 104 to prevent the dust. When a user presses the actuating structure 108 along the direction 120, the storage body 102 is pushed outside the housing 104.

Figure 2:
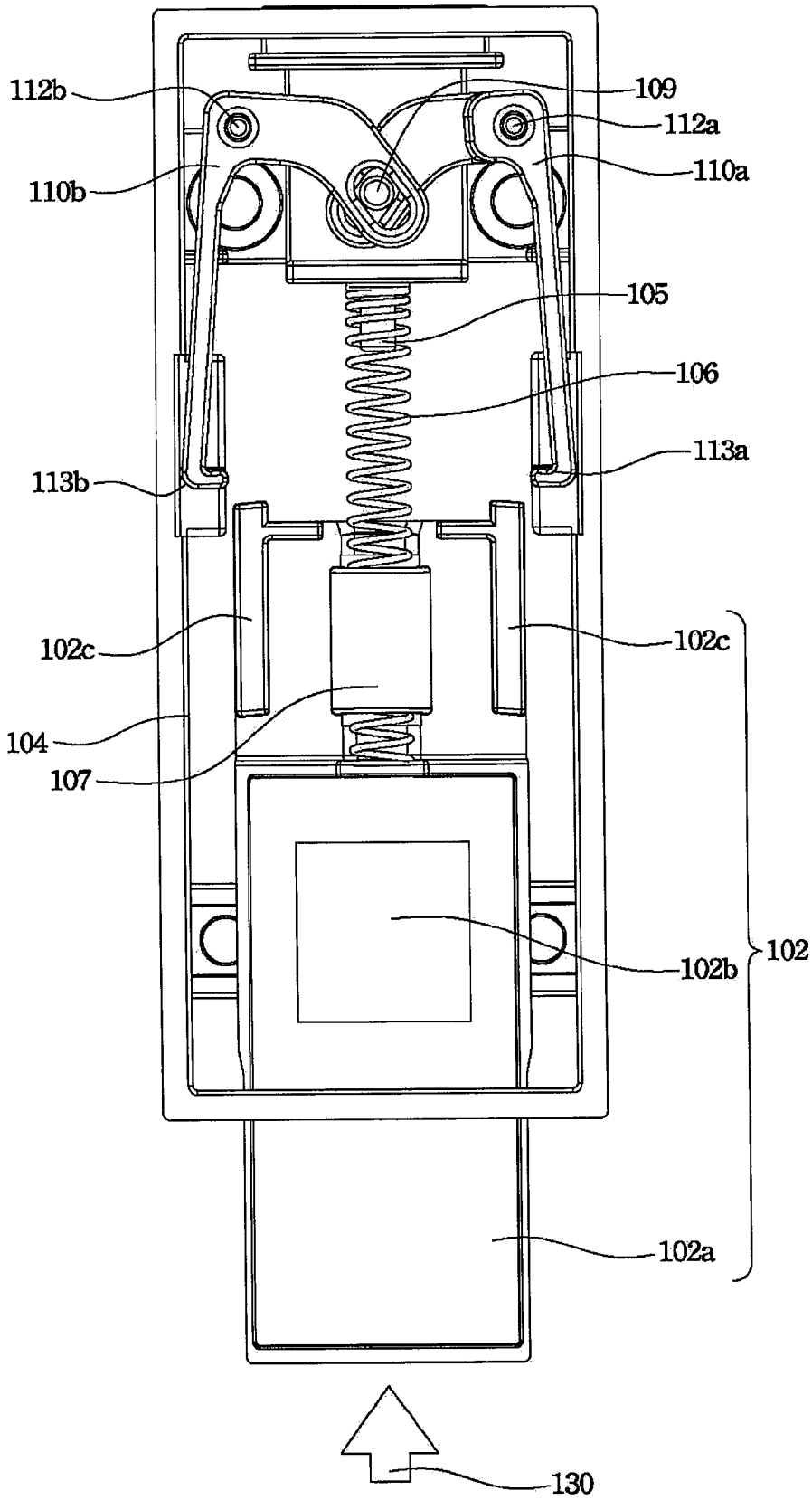
FIG. 2 is a top view showing a portable storage device (the storage body extending outside the housing) of one embodiment of the invention.

FIG. 2 is a top view showing a portable storage device (the storage body extending outside the housing) of one embodiment of the invention. Please refer to FIG. 1 and FIG. 2 simultaneously. When a user presses the actuating structure 108, the storage body 102 is pushed outside the housing 104 by the operation of the relative mechanisms. How to push the storage body 102 outside the housing 104 by the relative mechanisms is described hereinbelow. The relative mechanisms include an actuating structure 108, a pair of actuating arms 110*a* and 110*b*, a spring 106 and a pair of positional restriction structures 120*c*. The storage body 102 can be pushed outside the housing 104 by the elastic force of the spring 106. The interaction relationship between the actuating arms 110*a* and 110*b* and the positional restriction structures 102*c* determines that whether the storage body 102 is restricted in the housing 104 or be pushed outside the housing 104. The actuating structure 108 is pivotally connected to the actuating arms 110*a* and 110*b*, so that the user can operate the actuating arms 110*a* and 110*b* by the actuating structure 108 and control the position of the storage body 102.

Please refer to FIG. 1 again, when the storage body 102 hides in the housing 104, the hooked portions 113*a* and 113*b* of the actuating arms 110*a* and 110*b* hook one end of the positional restriction structures 102*c* on the storage body 102, so that it cannot be pushed outside the housing 104 by the elastic element (such as the spring 106). The actuating arms 110*a* and 110*b* are pivotally connected to the pivot 112*a* and 112*b* in the housing 104 and can swing. The actuating structure 108 is pivotally connected to the actuating arms 112*a* and 112*b*, so that the actuating structure 108 can act with the actuating arms 112*a* and 112*b*. In other words, the actuating structure 108 drives the actuating arms 112*a* and 112*b* to swing relatively. When the storage body 102 hides in the housing 104, two ends of the compressed spring 106 push the actuating structure 108 and the storage body 102, respectively, so that the hooked portions 113*a* and 113*b* of the actuating arms 112*a* and 112*b* draw back inward, and the hooked portions 113*a* and 113*b* can hook the bottom of the positional restriction structures (such as a pair of strip-shaped structures 102*c*) on the storage body 102 shown in FIG. 1. When the user pushes the actuating structure 108 along the direction 102, the storage body 102 is pushed outside the housing 104.

Please refer to FIG. 2 again. When the user presses the actuating structure 108 along the direction 120, the actuating arms 112*a* and 112*b* splay (or release) like that shown in FIG. 2. Once the user does not press the actuating structure 108, the pair of actuating arms 112*a* and 112*b* is in an inward draw-back state, which is shown in FIG. 1 by the pushing force of the spring 106 (which pushes the actuating structure 108 and the storage body 102). The hooked portions 113*a* and 113*b* of the actuating arms in an inward draw-back status are against the top of the positional restriction structures (such as strip-shaped structures 102*c* shown in FIG. 2) shown in FIG. 2, so that the user cannot press the storage body 102 back to the housing 104 along the direction 130. If the user wants to press the storage body 102 back to the housing 104, he or she needs to press the actuating structure 108 again to make the actuating arms 112*a* and 112*b* splay (or release) like that shown in FIG. 2.

The storage body 102 is provided in the housing 104 and can move relatively to the housing 104. The storage body 102 has a connector 102*a* (such as a universal serial bus (USB) connector) and a memory chip 102*b*. The connector 102*a* is used to plug into a corresponding connector slot (such as a connector slot of a computer) to make the memory chip 102*b* be read or store data. The memory chip 102*b* is a nonvolatile memory (such as a flash memory).

Figure 3:
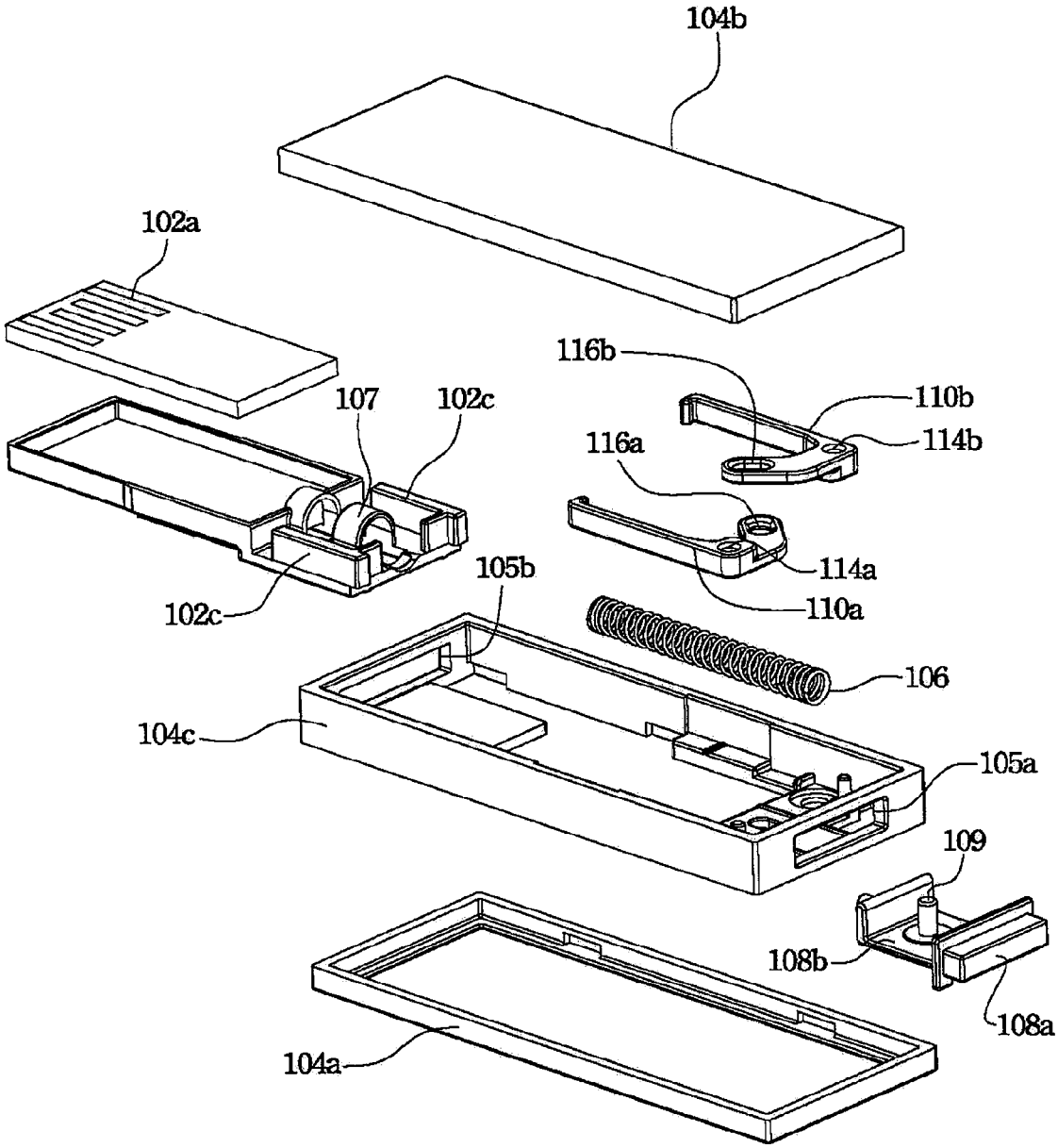
FIG. 3 is an explosive view showing a portable storage device of one embodiment of the invention.

FIG. 3 is an explosive view showing a portable storage device of one embodiment of the invention. Please refer to FIGS. 1~3 simultaneously. The connecting relationships between each element are described hereinbelow. The housings 104*a*, 104*b* and 104*c* shown in FIG. 3 compose a complete housing 104. The housing 104*b* has an opening 105*a* and an opening 105*b*. The opening 105*b* enables the connector 102*a* of the storage body 102 sliding in the housing to extend outside the housing or hide in the housing. The opening 105*a* enables the button portion 108*a* of the actuating structure 108 sliding in the housing to expose outside the housing to be pressed by the user. The storage body 102 connects parts of spring 106 by a spring sleeve 107. The actuating structure 108 has a pillar-shaped portion 105 for connecting the spring 106. The actuating arms 110*a* and 110*b* have oval holes 116*a* and 116*b*, respectively, for being connected to the actuating pivot 109 on the connecting portion 108*b* of the actuating structure 108. The actuating arms 110*a* and 110*b* also have assembling holes 114*a* and 114*b*, respectively, for being pivotally connected to the pivots 112*a* and 112*b* in the housing. After each element shown in FIG. 3 is assembled, the portable storage device can work as stated above.

From the embodiment of the invention, we can know that using the portable storage device of the invention, a user can control the connector to extend outside the housing or hide in the housing by a single button conveniently.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A portable storage device comprising:

a housing having a first opening and a second opening;

a storage body having a connector and a pair of positional restriction structures, wherein the storage body is provided in the housing and can move relatively to the housing, so that the connector can extend outside the housing or hide in the housing via the first opening;

a pair of actuating arms which is provided in the housing and can swing relatively, wherein when the storage body hides in the housing, the pair of actuating arms block the pair of positional restriction structures;

an actuating structure, wherein the actuating structure partially exposes outside the housing via the second opening, and the actuating structure is pivotally connected to the pair of actuating arms and can be forced to slide to drive the pair of actuating arms to swing relatively to release the pair of positional restriction structures; and an elastic element connected to the actuating structure and the storage body, wherein when the pair of positional restriction structures is released, the elastic element pushes the storage body, so that the connector extends outside the housing via the first opening and the pair of actuating arms return to the original position to block the positional restriction structures.

2. The portable storage device according to claim 1, wherein the connector is a universal serial bus (USB) connector.

3. The portable storage device according to claim 1, wherein the storage body further comprises a memory chip.

4. The portable storage device according to claim 3, wherein the memory chip is a nonvolatile memory.

5. The portable storage device according to claim 4, wherein the nonvolatile memory is a flash memory.

6. According to the portable device according to claim 1, wherein when the connector extends outside the housing, the actuating structure is forced to drive the pair of actuating arms to swing relatively to release the pair of positional restriction structures, so that the connector is forced to hide in the housing and the pair of the actuating arms return to the original position to fix the positional restriction structures.

7. The portable storage device according to claim 1, wherein the pair of the actuating arms comprises a pair of hooked portions.

8. The portable storage device according to claim 1, wherein the pair of positional restriction structures is a pair of strip-shaped structures.

9. The portable storage device according to claim 1, wherein the pair of actuating arms has a pair of oval holes.

10. The portable storage device according to claim 9, wherein the actuating structure has an actuating pivot connected to the oval holes.

11. The portable storage device according to claim 1, wherein the elastic element includes a spring, and the storage body further comprises a spring sleeve for ringing parts of the spring.

* * * * *